US010961486B2

(12) United States Patent
Piorkowski

(10) Patent No.: US 10,961,486 B2
(45) Date of Patent: Mar. 30, 2021

(54) UNIT DOSE DETERGENT PACKS WITH ANTI-YELLOWING AND ANTI-EFFLORESCENCE FORMULATIONS

(71) Applicant: Henkel IP & Holding GmbH, Duesseldorf (DE)

(72) Inventor: Daniel T. Piorkowski, Fairfield, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 109 days.

(21) Appl. No.: 16/198,560

(22) Filed: Nov. 21, 2018

(65) Prior Publication Data

US 2020/0157475 A1 May 21, 2020

(51) Int. Cl.

| | |
|---|---|
| ***C11D 1/04*** | (2006.01) |
| ***C11D 1/12*** | (2006.01) |
| ***C11D 3/04*** | (2006.01) |
| ***C11D 3/30*** | (2006.01) |
| ***C11D 11/00*** | (2006.01) |
| ***C11D 17/04*** | (2006.01) |
| ***C11D 1/22*** | (2006.01) |
| ***C11D 3/382*** | (2006.01) |
| ***C11D 3/20*** | (2006.01) |
| ***C11D 3/34*** | (2006.01) |
| ***C11D 1/38*** | (2006.01) |
| ***C11D 1/02*** | (2006.01) |

(52) U.S. Cl.

CPC ..... *C11D 11/0017* (2013.01); *C11D 1/02* (2013.01); *C11D 1/22* (2013.01); *C11D 1/38* (2013.01); *C11D 3/046* (2013.01); *C11D 3/2079* (2013.01); *C11D 3/2082* (2013.01); *C11D 3/30* (2013.01); *C11D 3/3463* (2013.01); *C11D 3/382* (2013.01); *C11D 11/0094* (2013.01); *C11D 17/043* (2013.01)

(58) Field of Classification Search

CPC ..... C11D 1/02; C11D 1/38; C11D 3/2082; C11D 3/2079; C11D 3/30; C11D 3/3463; C11D 3/42; C11D 17/043

USPC ..... 510/296, 357, 394, 477, 480, 488, 499, 510/439

See application file for complete search history.

(56) References Cited

U.S. PATENT DOCUMENTS

| | | | |
|---|---|---|---|
| 6,037,319 | A | 3/2000 | Dickler et al. |
| 7,259,134 | B2 | 8/2007 | Beckholt et al. |

(Continued)

FOREIGN PATENT DOCUMENTS

| | | | |
|---|---|---|---|
| WO | 2004003120 | A2 | 1/2004 |
| WO | 2006050298 | A2 | 5/2006 |
| WO | 2016040629 | A1 | 3/2016 |

*Primary Examiner* — Gregory R Delcotto

(74) *Attorney, Agent, or Firm* — Bojuan Peng

(57) ABSTRACT

Unit dose pack and methods for preventing efflorescence and yellowing of a wash composition for unit dose packs are provided. In accordance with one embodiment, a unit dose pack includes a wash composition and a film encapsulating the wash composition. The wash composition includes an ionic surfactant, water, sodium sulfite, and a chelating compound. The sodium sulfite is present in the wash composition at a concentration of from about 0.5 to about 3 weight percent, and the chelating compound is present in the wash composition at a concentration of from about 0.01 to about 1.5 weight percent, where weight percents are based on a total weight of the wash composition.

19 Claims, 2 Drawing Sheets

(56) References Cited

U.S. PATENT DOCUMENTS

| | | | | |
|---|---|---|---|---|
| 2003/0114332 | A1 | 6/2003 | Ramcharan et al. | |
| 2005/0101505 | A1 | 5/2005 | Wood | |
| 2006/0094617 | A1 | 5/2006 | Price et al. | |
| 2006/0166856 | A1 | 7/2006 | Petrat et al. | |
| 2010/0305014 | A1* | 12/2010 | Miralles | C11D 1/825 510/138 |
| 2011/0065625 | A1* | 3/2011 | Boutique | C11D 3/2093 510/336 |
| 2011/0112005 | A1 | 5/2011 | Brooker et al. | |
| 2012/0135910 | A1 | 5/2012 | Gross et al. | |
| 2014/0274859 | A1 | 9/2014 | Adamy | |
| 2014/0323383 | A1* | 10/2014 | Trujillo | C11D 17/043 510/439 |
| 2015/0105311 | A1* | 4/2015 | Boutique | C11D 3/2093 510/296 |
| 2015/0376556 | A1* | 12/2015 | Ohtani | C11D 17/045 510/386 |
| 2016/0040101 | A1* | 2/2016 | De Poortere | C11D 3/2075 510/296 |
| 2016/0177222 | A1 | 6/2016 | Bianchetti et al. | |
| 2016/0257914 | A1* | 9/2016 | Catlin | C11D 1/722 |
| 2016/0376522 | A1 | 12/2016 | Bianchetti et al. | |
| 2019/0390144 | A1* | 12/2019 | Piorkowski | C11D 3/2086 |

* cited by examiner

UNIT DOSE DETERGENT PACKS WITH ANTI-YELLOWING AND ANTI-EFFLORESCENCE FORMULATIONS

FIELD OF THE INVENTION

The technical field relates to unit dose packs that include a wash composition and methods of preventing efflorescence and yellowing of a wash composition for unit dose packs, and more particularly relates to unit dose packs with reduced yellowing over time without efflorescence, and methods of producing and using the same.

BACKGROUND OF THE INVENTION

Detergent in unit dose packs is available for a variety of washing activities, such as garment laundering and dish washing. The unit dose pack provides a pre-measured quantity of detergent that is easy to carry and convenient to use. The unit dose pack minimizes over-dosage of detergent and has proven popular with consumers.

Many unit dose packs include a wash composition that is encapsulated within a pouch made of a water soluble film, where the wash composition includes detergent, solvents, and other components useful for cleaning or other purposes. In many cases, the film is clear, so the contents are visible. Some consumers interested in reduced environmental impact prefer a "free and clear" product, where the product is free of colorants and perfumes, so the product appears clear. However, some components of the wash composition tend to degrade and form colored bodies over time. For example, monoethanol amine may be utilized as a pH adjusting agent to help control the pH of the wash composition, and monoethanol amine degradation products tend to have a yellow color that makes the entire wash composition appear yellow. Other components may also degrade to form colored bodies as well, or may have a color before degradation. This yellow color may be negatively perceived by some consumers.

Some materials in the wash composition can cause efflorescence in the film, where efflorescence is the migration of a salt or other solid to the surface of a solid. In the case of unit dose packs, materials that include sodium tend to effloresce in the film such that the film appears "grainy" or "hazy." Some materials that may reduce the formation of colored bodies include sodium, so these materials may result in efflorescence in the film. The grainy appearance of a film with efflorescence may be negatively perceived by consumers.

Accordingly, it is desirable to provide a unit dose pack where the wash composition resists yellowing, or at least acquires a yellow color at a slower rate and/or at lower color levels than traditional unit dose packs, including methods of producing and using the same. In addition, it is desirable to provide unit dose packs that do not exhibit minimized efflorescence in the film over time, and methods of producing and using the same. Furthermore, other desirable features and characteristics will become apparent from the subsequent detailed description and the appended claims, taken in conjunction with the accompanying drawings and the foregoing technical field and background.

BRIEF SUMMARY OF THE INVENTION

Unit dose pack and methods for of preventing efflorescence and yellowing of a wash composition for unit dose packs are provided. In accordance with one embodiment, a unit dose pack includes a wash composition and a film encapsulating the wash composition. The wash composition comprises an ionic surfactant, water, sodium sulfite, and a chelating compound. The sodium sulfite is present in the wash composition at a concentration of from about 0.5 to about 3 weight percent, and the chelating compound is present in the wash composition at a concentration of from about 0.01 to about 1.5 weight percent, where weight percents are based on a total weight of the wash composition.

A unit dose pack is provided in another embodiment. The unit dose pack includes a wash composition and a film encapsulating the wash composition. The wash composition comprises (1) sodium sulfite at from about 0.5 to about 2 weight percent, (2) a chelating agent at from about 0.5 to about 1 weight percent, where the chelating agent comprises tetrasodium iminodisuccinate; (3) an ionic surfactant at from about 2 to about 12 weight percent; and (4) water at from about 10 to about 25 weight percent, where all weight percents are based on a total weight of the wash composition. A chelator to sulfite ratio is from about 1:1 to about 1:2, where the chelator to sulfite ratio is the ratio of the weight percent of the chelating compound to the weight percent of the sodium sulfite. The wash composition is free of a dye and free of a pigment.

A method of preventing efflorescence and yellowing of a wash composition is provided in yet another embodiment. The method includes forming the wash composition comprising an ionic surfactant, water, sodium sulfite at from about 0.05 to about 3 weight percent, and a chelating compound at from about 0.01 to about 1.5 weight percent, where weight percents are based on a total weight of the wash composition.

BRIEF DESCRIPTION OF THE DRAWINGS

The present embodiments will hereinafter be described in conjunction with the following drawing figures, wherein like numerals denote like elements, and wherein.

DETAILED DESCRIPTION OF THE INVENTION

Figure 1:
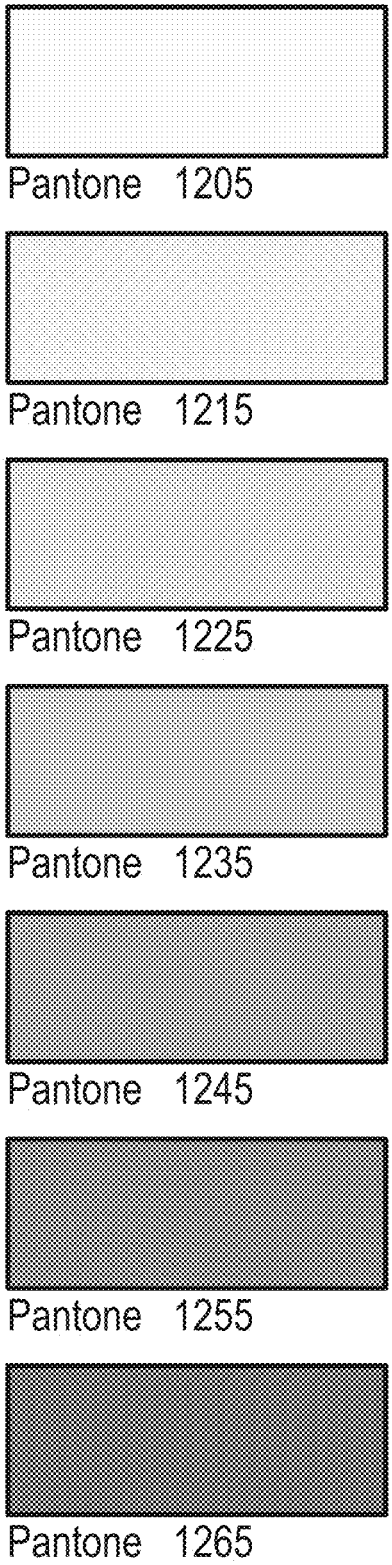
FIG. 1 is a representation of the Pantone color index.

The following detailed description is merely exemplary in nature and is not intended to limit the unit dose pack, or the method for producing or using the same. Furthermore, there is no intention to be bound by any theory presented in the preceding background or the following detailed description.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

A unit dose pack includes a wash composition encapsulated within a film container that is transparent. The wash composition includes a surfactant, solvents, and other components. The wash composition also includes sodium sulfite and a chelating compound. The combination of the sodium sulfite and the chelating compound has been found to reduce yellowing while minimizing or eliminating efflorescence in the film, even when stored for several weeks at average storage temperatures of 45 degrees Celsius.

A unit dose pack is formed by encapsulating a wash composition within a container, where the container includes a film. In some embodiments, the film forms one half or more of the container, where the container may also include dyes, print, or other components in some embodiments. The film is water soluble such that the film will completely dissolve when an exterior of the film is exposed to water, such as in a washing machine typically used for laundry. When the film dissolves, the container ruptures and the contents are released. As used herein, "water soluble" means at least 2 grams of the solute (the film in one example) will dissolve in 5 liters of water, for a solubility of at least 0.4 grams per liter (g/l), at a temperature of 25 degrees Celsius (° C.) unless otherwise specified. Suitable films for packaging are rapidly and completely soluble in water at temperatures of about 5° C. or greater.

The film is desirably strong, flexible, shock resistant, transparent, and non-tacky during storage at both high and low temperatures and high and low humidity's. In an exemplary embodiment, the film is initially formed from polyvinyl acetate, and at least a portion of the acetate functional groups are hydrolyzed to produce alcohol groups. Therefore, the film includes polyvinyl alcohol (PVOH), and may include a higher concentration of PVOH than polyvinyl acetate. Such films are commercially available with various levels of hydrolysis, and thus various concentrations of PVOH. In an exemplary embodiment the film initially has about 85 percent of the acetate groups hydrolyzed to alcohol groups, but other percentages of hydrolysis are also possible in alternate embodiments. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 65 to about 90 μm in various embodiments. The film may include alternate materials in some embodiments, such as methyl hydroxy propyl cellulose and polyethylene oxide, but the film is water soluble in all embodiments.

The unit dose pack may be formed from a container having a single section, but the unit dose pack may be formed from containers with two or more different sections in alternate embodiments. In embodiments with a container having two or more sections, the contents of the different sections may or may not be the same. In some embodiments, the unit dose pack is formulated and configured for cleaning laundry, but other cleaning purposes are also possible. The wash composition is positioned within the container, and the container is sealed to encapsulate and enclose the wash composition. The wash composition is typically in direct contact with the film of the container within the unit dose pack. The film of the container is sealable by heat, heat and water, ultrasonic methods, or other techniques, and one or more sealing techniques may be used to enclose the wash composition within the container.

In an exemplary embodiment, the wash composition is liquid when encapsulated within the container. The liquid wash composition may have a viscosity of from about 100 to about 1,000 centipoise, or from about 100 to about 300 centipoise in different embodiments, where "viscosity," as used herein, means the viscosity measured by a rotational viscometer at a temperature of 25 degrees Celsius (° C.,) using an LV02 cylindrical spindle at about 20 revolutions per minute (RPM) with a Brookfield® DV2T viscometer. The liquid form facilitates rapid delivery and dispersion of the wash composition once the container ruptures, and this rapid dispersion can aid cleaning. In alternate embodiments, the wash composition is flowable, such as a gel, a liquid with suspended particulates, or other forms.

In an exemplary embodiment, the unit dose pack is sized to provide a desired quantity of wash composition for one load of laundry or one batch of dishes in a dishwasher. The unit dose pack may also be sized for a fraction of a desired quantity, such as one half of a load of laundry, so a user can adjust the amount of detergent added without having to split a unit dose pack. In an exemplary embodiment, the unit dose pack has a weight of from about 5 to about 50 grams. In alternate embodiments, the unit dose pack is from about 10 to about 40 grams, or from about 15 to about 25 grams.

A plurality of components are combined to form the wash composition, where the wash composition is typically prepared prior to encapsulation within the container. A total weight of the wash composition does not include the weight of the film or the container, where the total weight of the wash composition is generally referenced herein as the basis for the weight percent of components of the wash composition. Unless otherwise specified, the concentration of all components described herein, other than the film, is the weight percent of the named component based on the total weight of the wash composition.

Figure 2:
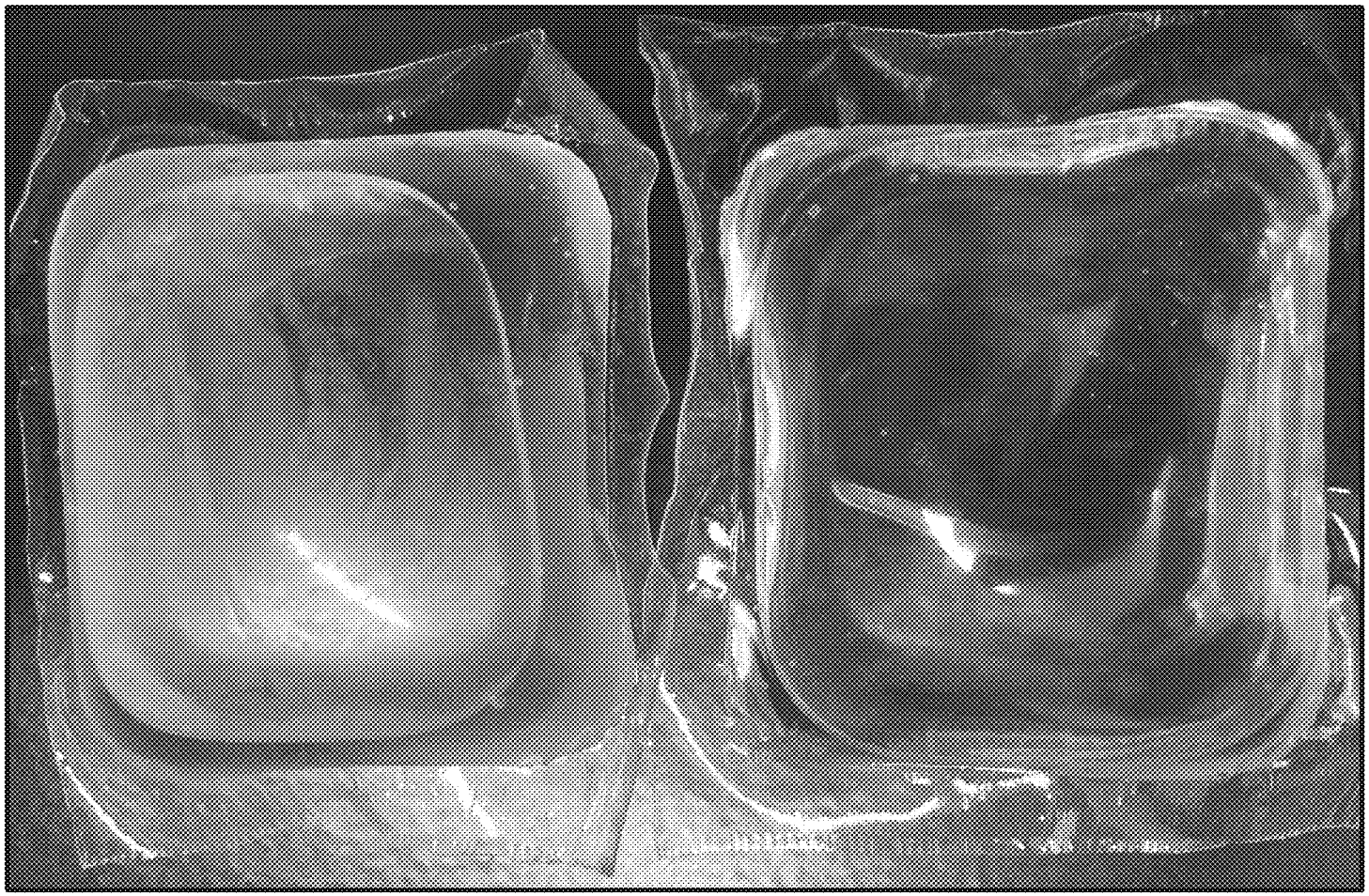
FIG. 2 is a photo illustrating a unit dose with efflorescence compared to a unit dose free of efflorescence.

The wash composition includes sodium sulfite and a chelating compound. The combination of sodium sulfite and the chelating compound has been found to significantly reduce yellowing, especially during extended storage at elevated temperatures, and at the same time maintaining the status of having no or substantially no efflorescent solids formed in the film. Yellowing is measured herein using the Pantone color value, as illustrated in FIG. 1. FIG. 1 is in black and white, but the change in hue is evident, and the actual Pantone color value has a yellow color combined with the change in hue. The efflorescent effect can be seen in FIG. 2, where two unit doses are shown. The bottom unit dose has no efflorescence, and the top unit dose has significant efflorescence, where the efflorescence is seen as a white cloudy area on the film surface of the unit dose. "Substantially no efflorescent solids" means about 5% or less of the surface area of the film is visually cloudy, as described more fully below. The reduced yellowing without efflorescent solids that results from a combination of sodium sulfite and the chelating compound is an unexpected result.

Sodium sulfite is an oxygen scavenger, where sodium sulfite reacts with oxygen to form sodium sulfate. Free oxygen, such as oxygen dissolved in the wash composition, can react to produce metal oxides (rust) that reduce the life of the washing equipment. The metal oxides can also stain garments, dishes, or other items being washed. Dissolved oxygen can also react to produce other components, and some of those components may be colored bodies. Therefore, the sodium sulfite can help reduce the formation of colored bodies in the wash composition. However, sodium sulfite includes sodium, and sodium-containing compounds tend to produce efflorescent solids in the film.

Many film manufacturers caution against the use of sodium-containing compounds in a wash composition because sodium can cause efflorescence solids to form in the film. Efflorescence results when a component is carried into the film, and that component or a portion thereof precipitates within the film. The solubility of the efflorescence component may be different in the film than in the wash composition, but other reasons for the efflorescence may also be possible. In any event, efflorescence is undesirable because it causes a "cloudy", opaque, or otherwise unattractive appearance of the film. In an exemplary embodiment, the film is free of efflorescence solids. Efflorescence produces a white, cloudy appearance to the film that can be visually observed, and the percentage of the surface area of the film that is clouded by efflorescence can be visually observed and recorded. Efflorescence may be observed by placing a unit dose on a black background and then viewing the unit dose. Any portion of the unit dose that appears black due to the underlying black background is considered free of efflorescent solids, and any portion that appears white is considered to have efflorescent solids. In some embodiments, the unit dose may appear somewhat yellow or other colors based on coloration within the wash composition, so areas of the unit dose that do not appear white but may appear black, yellow or other colors besides white are considered free of efflorescence. Efflorescence forms where the film contacts the wash composition, so portions of the film that do not directly contact the wash composition do not include efflorescent solids and not included in the determination of the percentage of the surface area of the film with efflorescent solids. As used herein, a film is "free of efflorescent solids" if about 1% or less of the surface area of the film is visually cloudy such that about 1% or less of the unit dose pack appears white when viewed over a black background surface. The term "substantially free of efflorescent solids" means about 5% or less of the surface area of the film is visually cloudy such that about 5% or less of the unit dose pack appears white when viewed over a black background surface, as mentioned above. The percentage of the film that is cloudy can be used to quantify the degree of efflorescence in the film, as listed below in the examples section.

A chelating compound binds and removes various metals from water, such as calcium, magnesium, sodium, or other metals. Chelating compounds are sometimes referred to as water softeners. Many compounds can be used as chelating compounds, including but not limited to iminodisuccinate (IDS), ethylenediaminetetraacetic acid (EDTA), nitrilotriacetic acid, diethylenetriaminepenta(methylenephosphonic acid), nitrilotris(methylenephosphonic acid), 1-hydroxyethane-1,1-diphosphonic acid, ethylenediamine-N,N'-disuccinic acid (EDDS), hydroxyethylenediaminetriacetic acid (HEDTA), or other chelating compounds. However, a chelating compound may itself contain cations. For examples, IDS may contain four sodium atoms (tetrasodium), and as a result, the cations may facilitate formation of undesirable efflorescence solids. Accordingly, it was expected that when IDS and sodium sulfite were added into the same composition, it would effloresce faster than a product containing sodium sulfite without any IDS or other chelating agent. However, to the inventor's surprise, the opposite result occurred—the combination of IDS and sodium sulfite actually reduced or eliminated efflorescence. It has also been unexpected discovered that the combination of IDS and sodium sulfite within a wash composition synergistically increases the anti-yellowing effect of the sodium sulfite compound. Without being bound by theory, it is believed that the IDS prevents the sodium sulfite from efflorescing (i.e., the IDS keeps the sodium sulfite in solution), which allows it to continue reducing yellowing reactions within the wash composition. Therefore, wash compositions including both IDS and sodium sulfite have been found to be less yellow than wash compositions with sodium sulfite but without IDS and without other chelating compounds.

As mentioned above, the wash composition includes sodium sulfite. In different embodiments, the sodium sulfite is present in the wash composition at a concentration of from about 0.05 to about 4 weight percent, or from about 0.05 to about 3 weight percent, or from about 0.05 to about 2 weight percent, all based on the total weight of the wash composition.

The chelating compound is present in the wash composition at an amount of from about 0.01 to about 1.5 weight percent in an exemplary embodiment, but in alternate embodiments the chelating compound is present at an amount of from about 0.035 to about 1.25 weight percent, or an amount of from about 0.05 to about 1 weight percent, or an amount of from about 0.05 to about 0.5 weight percent, based on the total weight of the wash composition. In an exemplary embodiment, the chelating compound includes sodium, such as two or more sodium atoms per molecule of chelating compound. In some embodiments, the chelating compound includes tetrasodium IDS, and the chelating compound may include one, two, or more different chelating chemicals in various embodiments. The chelating compound and the sodium sulfite are present in the wash composition at a chelator to sulfite ratio, which is a ratio of the weight percent of the chelating agent to the weight percent of the sodium sulfite. In an exemplary embodiment, the chelator to sulfite ratio of from about 5:1 to about 1:5, but in alternate embodiments the chelator to sulfite ratio may be from about 4:1 to about 1:4, or from about 3:1 to about 1:1, or from about 2:1 to about 1:1.

In an exemplary embodiment, the wash composition is free of dyes and pigments. Wash compositions that are free of dyes and pigments may be referred to as "free and clear," meaning the wash composition is free of dyes and pigments, and may be free of fragrance components. Some consumers prefer products that are free of dyes, pigments and/or fragrances, because such products are perceived as being more environmentally friendly. Some components that are not a dye or a pigment may have some color, where that component is primarily used for a purpose other than imparting color. In some embodiments, the component itself does not impart color, but a breakdown product or a by-product of that component does impart a visible color. For example, some pH adjusting agents have breakdown products that impart color, where the pH adjusting agent is primarily added to neutralize acids and thereby adjust the pH of the wash composition. In free and clear products, components that impart a color are generally undesirable.

A solvent is a component that is utilized as a carrier in a formulation, where other components (solutes) are dissolved in the solvent. Solvents generally solvate solutes and act as bulk fillers for the formula when used below a certain use-level so as to not plasticize the film. Specific criteria that precisely and exactly define what is or is not a solvent are difficult to define, because some components may have more than one purpose. Generally, solvents for liquid formulations are liquids at standard conditions (i.e., 1 atmosphere pressure and 20 degrees Celsius (° C.)). Typically, ionic surfactants, nonionic surfactants, optical brighteners, dyes or pigments, bleach activators or agents, enzymes, perfumes or other ingredients added for odor purposes, bittering agents, peroxy compounds, soil release agents, dye transfer inhibitors, foam inhibitors, chelators or other water softeners are not considered "solvents." The wash composition includes one or more solvents in an exemplary embodiment. For example, water may be present in the wash composition at a concentration of from about 5 to about 45 weight percent, or present in an amount of from about 5 to about 35 weight percent, or present in an amount of from about 7 to about 28 weight percent, or present in an amount of from about 10 to about 25 weight percent in various embodiments, based on the total weight of the wash composition. Other non-aqueous solvents that may be included in the wash composition include, but are not limited to, glycerol, propylene glycol, ethylene glycol, ethanol, and a 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3 propanediol; xylitol; mannitol; erythritol; dulcitol; inositol; adonitol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl) methyl ammonium methylsulfate; ethylene oxide/propylene oxide copolymers with a number average molecular weight of 3,500 Daltons or less; and ethoxylated fatty acids.

The wash composition includes other components as well. For example, the wash composition may include one or more ionic surfactants, where the ionic surfactant is formulated for laundry in an exemplary embodiment. The ionic surfactant may include one or more surfactants, including cationic and/or anionic surfactants, in various embodiments. The ionic surfactant may be present in the wash composition at a concentration of from about 5 to about 55 weight percent in one embodiment, but the ionic surfactant may be present in the wash composition at a concentration of about 5 to about 45 weight percent, or from about 10 to about 40 weight percent, or from about 10 to about 35 weight percent, or from about 15 to about 30 weight percent in alternate embodiments, based on a total weight of the wash composition.

Suitable ionic surfactants that are anionic include soaps which contain sulfate or sulfonate groups, including those with alkali metal ions as cations. Usable soaps include alkali metal salts, amine salts, or other salts of saturated or unsaturated fatty acids with 12 to 18 carbon (C) atoms. Such fatty acids may also be used in incompletely neutralized form, such that some of the fatty acids are present in a salt form and other fatty acids are present in a free acid form where an acid group is protonated. Usable ionic surfactants of the sulfate type include sulfuric acid semi esters of fatty alcohols with 12 to 18 C atoms, and/or alcohol ethoxysulfates, where these compounds may be present in a salt form. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide. Another type of sulfonate surfactant includes alpha-sulfofatty acid esters such as those that arise from the sulfonation of fatty acid methyl or ethyl esters, and lauryl ether sulfates.

In an exemplary embodiment, the wash composition includes linear alkyl benzene sulfonic acid surfactants as the ionic surfactant at a concentration of from about 1 to about 15 weight percent, or from about 2 to about 12 weight percent, or from about 4 to about 8 weight percent in different embodiments. In an exemplary embodiment, linear alkylbenzene sulfonates include 9 to 14 C atoms in the alkyl moiety. In alternate embodiments, the wash composition is free of linear alkyl benzene sulfonic acid surfactants. As used herein, "free of" means the named component is present in an amount of about 1 weight percent or less, based on a total weight of the named composition (such as the wash composition), unless otherwise specified. Some linear alkyl benzene sulfonic acid surfactants may have some color, and the use of linear alkyl benzene sulfonic acids also tends to increase the total quantity of pH adjusting agent required in the wash composition. Some pH adjusting agents tend to produce colored degradation products.

Suitable ionic surfactants that are cationic may include textile-softening substances of the general formula X, XI, or XII as illustrated below:

(X)

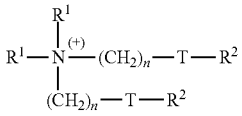

(XI)

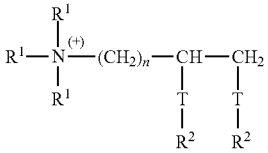

(XII)

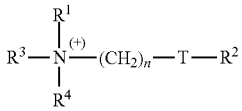

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO—, or —CO—O—, and n is an integer from 0 to 5. The ionic surfactants that are cationic may include conventional anions of a nature and number required for charge balancing. Alternatively, the ionic surfactant may include anionic surfactants that may function to balance the charges with the cationic surfactants. In some embodiments, ionic surfactants that are cations may include hydroxyalkyltrialkylammonium compounds, such as $C_{12-18}$ alkyl(hydroxyethyl)dimethyl ammonium compounds, and may include the halides thereof, such as chlorides or other halides. The ionic surfactants that are cations may be especially useful for compositions intended for treating textiles.

Nonionic surfactants may optionally be present in the wash composition at a concentration of from about 0 to about 60 weight percent, or from about 5 to about 50 weight percent, or from about 10 to about 40 weight percent, or from about 15 to about 30 weight percent in various embodiments, based on the total weight of the wash composition. Suitable nonionic surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Several other components may optionally be added to and included in the wash composition, including but not limited to water-binding saccharides, enzymes, peroxy compounds, bleach activators, anti-redeposition agents, pH adjusting agents, optical brighteners, foam inhibitors, buttering agents, dye transfer inhibitors, soil release agents, and other components. A partial, non-exclusive list of additional components that may be added to and included in the wash composition include electrolytes, pH regulators, graying inhibitors, anti-crease components, processing aids, antimicrobial agents, and preservatives.

Water binding saccharides are optionally included in the wash composition. In some embodiments, the saccharide is selected from the group consisting of fructose, glucose, sucrose, xylitol, sorbitol, mannitol, erythritol, dulcitol, inositol, adonitol, tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligoscaccharides, sorbose, nigero-oligosaccharides, palatinose oligosaccharides, fucose, fractooligosaccharides, maltotetraol, maltotriol, malto-oligosaccharides, lactulose, melibiose, raffinose, rhamnose, ribose, high fructose corn/starch syrup, coupling sugars, soybean oligosaccharides, or glucose syrup, and a mixture thereof.

One example of a saccharide that may be utilized is high fructose corn syrup (HFCS.) HFCS typically refers to a blend of approximately 23% water and 77% saccharide. For example, HFCS 55 typically refers to a blend of water (about 23%), glucose (about 34%), and fructose (about 42%). However, in a dried form, HFCS 55 contains approximately 55% fructose by weight of dry HFCS, where the number after the abbreviation HFCS generally refers to the percentage of fructose in a dry state. Unless otherwise stated, HFCS used herein refers to a wet blend which contains water, as it is supplied from HFCS manufacturers. However, it should be understood that dry or essentially dry hybrids of monosaccharides (e.g. HFCS), wherein water has been removed partially or completely, can also be used. Other HFCS products may also be used, such as HFCS 42, HFCS 65, HFCS 90, and others. While pure fructose is very viscous and hard to handle, HFCS is more dilute and easier to handle. HFCS is also more cost-effective to manufacture. The United States Food and Drug Administration has even determined that HFCS is a safe ingredient for food and beverage manufacturing. It is certainly a safe and green ingredient for detergent products.

Foam inhibitors may optionally be included in the wash composition. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, coconut fatty acids are used as foam inhibitors, but other embodiments are possible, such as mixtures of paraffins and bistearylethylenediamide. The wash composition may include the foam inhibitor at an amount of from about 0 to about 15 weight percent, but in other embodiments the foam inhibitor may be present at an amount of from about 0.05 to about 10 weight percent, or an amount of from about 0.5 to about 8 weight percent, based on the total weight of the wash composition.

PH adjusting agents may be added to and included in the wash composition. Exemplary pH adjusting agents include monoethanol amine, binary amines, buffers, triethanol amine, metal hydroxides, or other materials. Exemplary metal hydroxides are sodium hydroxide and/or potassium hydroxide, and other possible pH adjusting agents include compounds that adjust the pH of the wash composition. pH adjusting agents may be present in the wash composition at an amount of from about 0.1 to about 10 weight percent in some embodiments, based on the total weight of the wash composition, but in other embodiments the pH adjusting agent may be present in the wash composition at an amount of from about 0.5 to about 5 weight percent, or an amount of from about 1 to about 4 weight percent, based on the total weight of the wash composition. The pH adjusting agent may be utilized to adjust the pH of the wash composition to from about 6 to about 10, or from about 6.5 to about 9.5, or from about 7 to about 9 in various embodiments. The pH adjusting agent may form a cation that combines with an anionic surfactant and/or a coconut fatty acid or other foam inhibitor and/or another anionic component within the wash composition. In many cases, the pH adjusting agent forms a salt with an anionic component. As such, the anionic surfactant may be present in the wash composition as a surfactant salt, and the coconut fatty acid may be present in the wash composition as a coconut fatty acid salt. In some embodiments, the pH adjusting agent is included in a slight excess relative to the anionic surfactant or other acidic components to adjust the pH of the wash composition to within a desired range, such as the range(s) mentioned above. As used herein, the terms "anionic surfactant" and "coconut fatty acid" include the neutralization products thereof.

Possible enzymes that may be in the wash composition contemplated herein include one or more of a protease, lipase, cutinase, amylase, carbohydrase, cellulase, pectinase, mannanase, arabinase, galactanase, xylanase, oxidase, (e.g., a laccase), and/or peroxidase, but others are also possible. In general, the properties of the selected enzyme(s) should be compatible with the selected wash composition, (i.e., pH-optimum, compatibility with other enzymatic and non-enzymatic ingredients, etc.). The detergent enzyme(s) may be included in the wash composition by adding separate additives containing one or more enzymes, or by adding a combined additive comprising all the enzymes that are added to the wash composition. The enzyme(s) should be present in the wash composition in effective amounts, such as from about 0 weight percent to about 5 weight percent of enzyme, or from about 0.001 to about 5 weight percent, or from about 0.2 to about 3 weight percent, or from about 0.5 to about 3 weight percent, based on the total weight of the wash composition, in various embodiments. In an exemplary embodiment, the wash composition includes three or more different enzymes. In one embodiment, the wash composition includes protease, mannanase, and amylase, but other embodiments are also possible.

A peroxy compound may optionally be present in the wash composition. Exemplary peroxy compounds include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds include alkali metal percarbonates, alkali metal perborate monohydrates, alkali metal perborate tetrahydrates or hydrogen peroxide. Peroxy compounds may be present in the wash composition at an amount of from about 0 to about 15 weight percent, or an amount of from about 1 to about 10 weight percent, or an amount of from about 3 to about 5 weight percent, based on the total weight of the wash composition, in various embodiments.

Bleach activators may optionally be added and included in the wash composition. Conventional bleach activators that form peroxycarboxylic acid or peroxyimidic acids under perhydrolysis conditions and/or conventional bleach-activating transition metal complexes may be used. The bleach activator optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketopiperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators may be coated with shell substances or granulated prior to addition to the wash composition, in a known manner. As such, the bleach activator and/or other components may be present in a liquid wash composition as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In alternate embodiments, the peroxy compounds and bleach activators, if present, may be within separate chambers of the container to prevent premature interactions. In various embodiments, the bleach activators may be present in the wash composition in quantities of from about 0 to about 8 weight percent, or from about 0 to about 6 weight percent, or from about 0 to about 4 weight percent, in each case relative to the total weight of the wash composition.

One or more anti-redeposition agents may also be optionally included in the wash composition. Anti-redeposition agents include polymers with a soil detachment capacity, which are also known as "soil repellents" due to their ability to provide a soil-repelling finish on the treated surface, such as a fiber. One example in regard to polyesters includes copolyesters prepared from dicarboxylic acids, such as adipic acid, phthalic acid or terephthalic acid. In an exemplary embodiment, an anti-redeposition agents includes polyesters with a soil detachment capacity that include those compounds which, in formal terms, are obtainable by esterifying two monomer moieties, the first monomer being a dicarboxylic acid HOOC-Ph-COOH and the second monomer a diol HO—$(CHR^{11}—)_a$OH, which may also be present as a polymeric diol H—$(O—(CHR^{11}—)_a)_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. $R^{11}$ means hydrogen or an alkyl residue with 1 to 22 C atoms and mixtures thereof "a" means a number from 2 to 6 and "b" means a number from 1 to 300. The polyesters obtainable therefrom may contain not only monomer diol units —O—$(CHR^{11}—)_a$O— but also polymer diol units —$(O—(CHR^{11}—)_a)_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The number average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—$(CHR^{11}—)_a$OH include those in which $R^{11}$ is hydrogen and "a" is a number of from about 2 to about 6, and in another embodiment includes those in which "a" has the value of 2 and $R^{11}$ is selected from hydrogen and alkyl residues with 1 to 10 C atoms, or where $R^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with a number average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, and benzoic acid. These end groups may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, hydrogenation products thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent is present in the wash composition at an amount of from about 0 to about 5 weight percent, or an amount of from about 0 to about 4 weight percent, or an amount of from about 0 to about 3 weight percent, based on the total weight of the wash composition, in various embodiments.

Optical brighteners may optionally be included in the wash composition. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl) diphenyl. Mixtures of the above-stated optical brighteners may also be used. Optical brighteners may be present in the wash composition at an amount of from about 0 to about 5 weight percent in some embodiments, but in other embodiments optical brighteners are present in an amount of from about 0.005 to about 5 weight percent, or an amount of from about 0.01 to about 0.5 weight percent, or an amount of from about 0.05 to about 0.3 weight percent, based on the total weight of the wash composition.

Bittering agents may optionally be added to hinder accidental ingestion of the unit dose pack or the wash composition. Bittering agents are compositions that taste bad, so children or others are discouraged from accidental ingestion. Exemplary bittering agents include denatonium benzoate, aloin, and others. Bittering agents may be present in the wash composition at an amount of from about 0 to about 1 weight percent, or an amount of from about 0 to about 0.5 weight percent, or an amount of from about 0 to about 0.1 weight percent in various embodiments, based on the total weight of the wash composition.

Colored bodies may form in the wash composition when the unit dose pack is stored, where the colored bodies were not originally in the wash composition. For example, if a unit dose pack were stored for a storage period of about two weeks or more at a storage temperature of about 37 degrees Celsius (° C.) (about 100 degrees Fahrenheit (° F.)), the unit dose pack may produce colored bodies in the wash composition. The "storage temperature," as used herein, means at least an average temperature over the entire length of the storage period. As a general rule of thumb, chemical reaction rates tend to about double when the temperature is increased by about 10° C., so colored bodies could be expected to form in a unit dose pack that is maintained at a storage temperature of about 20° C. (about room temperature) for a storage period of about 2 months.

This extended storage (a storage period of about two weeks or more) at an elevated temperature of about 37° C. or more may also result in efflorescent solids forming in the film. In some embodiments, a unit dose pack is warehoused or stored for a period of time before use, and this storage is often for two weeks or more and at a temperature of 37° C. or more. Therefore, a unit dose pack that was originally produced without colored bodies and without efflorescent solids in the film may produce colored bodies and efflorescent solids in the film after storage. The degree of coloration of the wash composition can be quantified by a Pantone color value, where higher Pantone color values are darker than lower Pantone color values. In particular, Pantone color values of from 1205 to 1265 or greater are used to quantify the degree of coloration of the wash composition in this description. As used herein, a wash composition is "free of color" if the Pantone color value is from Pantone 1205 to Pantone 1215. A wash composition has "acceptable color" if the wash composition has a Pantone color value of from Pantone 1205 to Pantone 1245. A wash composition has an "unacceptable color" if the wash composition has a Pantone color value of from Pantone 1255 to Pantone 1265 or greater. The Pantone color value is measured by visual comparison of the wash composition to a Pantone color swatch, where the wash composition is viewed overlying a white background at a wash composition depth of 5 centimeters or less.

It has unexpectedly been discovered that the combination of sodium sulfite with a chelating compound results in a wash composition that has acceptable color and no efflorescent solids, even after storage at the storage period of six weeks or more at the storage temperature of 37° C. or more. In addition, it has been discovered that the combination of sodium sulfite with a chelating compound results in a wash composition that has acceptable color when stored at a storage period of 2 weeks, 4 weeks, 6 weeks, and even 8 weeks at a storage temperature of 41° C. Furthermore, it has been discovered that the combination of sodium sulfite with a chelating compound results in a wash composition that has acceptable color when stored at a storage period of 2 weeks, 4 weeks, 6 weeks, and 8 weeks at a storage temperature of 45° C. In particular, the combination of sodium sulfite and a chelating compound within the wash composition results in acceptable color when stored at a storage temperature of 41° C. or greater for a storage period of 6 weeks or more. The quantities of sodium sulfite and chelating compound that result in the acceptable color described in this paragraph are within the ranges described above. Higher storage temperatures tend to induce more efflorescence and more color, so storage at lower storage temperatures or shorter storage periods also produces acceptable color.

The wash composition may be prepared by combining and mixing the components of the wash composition with a mixer. Once mixed, the wash composition is encapsulated in the container. The components of the wash composition may all be mixed at one time, or different components may be pre-mixed and then combined. A wide variety of mixers may be used in alternate embodiments, such as an agitator, an in-line mixer, a ribbon blender, an emulsifier, and others. The wash composition is placed in a container, and then the film of the container is sealed with a sealer, where the sealer may utilize heat, water, ultrasonic techniques, water and heat, pressure, or other techniques for sealing the container and forming the unit dose pack.

Another exemplary embodiment contemplated herein is directed to the use of a unit dose pack as described above in a cleaning process, such as laundry and/or hard surface cleaning. In particular, an embodiment is directed to the use of a unit dose pack in laundering of textile and fabrics, such as house hold laundry washing and industrial laundry washing. A further exemplary embodiment is directed to the use of a unit dose pack in hard surface cleaning such as automated dish washing (ADW.)

The fabrics and/or garments subjected to a washing, cleaning or textile care process contemplated herein may be conventional washable laundry, such as household laundry. In some embodiments, the major part of the laundry is garments and fabrics, including but not limited to knits, woven fabrics, denims, non-woven fabrics, felts, yarns, and toweling. The fabrics may be cellulose based, such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above-mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the unit dose pack is also added to the washing machine before wash water is added. In an alternate embodiment, the unit dose pack may be added to an automatic detergent addition system of a washing machine, where the contents of the unit dose pack are added to the wash water with the fabrics and/or garments after the washing process has begun. In yet another embodiment, the unit dose pack is manually added to the fabrics and/or garments with the wash water after the washing process has started. The film dissolves and releases the wash composition into the aqueous wash water. The film is dissolved and washes out of the washing machine with the excess wash water, so there is nothing to collect from the fabrics and/or garments after the wash cycle. The fabrics and/or garments are laundered with the wash water and the contents of the unit dose pack. The fabrics and/or garments may then be dried and processed as normal.

In an alternate embodiment, the unit dose pack is added to a detergent charging system for an automatic dish washing machine. The detergent charging system opens and releases the unit dose pack to the wash water and a main compartment of the dish washing machine at a designated point in the wash cycle.

Examples

Comparative samples and test samples of unit dose packs were prepared with the ingredients listed in Table 1, below. Table 1 provides compositions of three samples that were evaluated for yellowing and efflorescence.

TABLE 1

| Component | % activity | Sample 1 comparative | Sample 2 comparative | Sample 3 Sulfite and chelator |
|---|---|---|---|---|
| C12-15 alcohol ethoxylate | 99.85 | 23.1 | 23.1 | 23.1 |
| glycerin | 99.85 | 11.8 | 11.2 | 10.3 |

TABLE 1-continued

| Component | % activity | Sample 1 comparative | Sample 2 comparative | Sample 3 Sulfite and chelator |
|---|---|---|---|---|
| Propylene glycol, 400 mw | 99.9 | 8.2 | 8.2 | 8.2 |
| Monoethanol amine | 99.85 | 3.2 | 3.2 | 3.2 |
| Linear alkyl benzene sulfonic acid | 95 | 5.0 | 5.0 | 5.0 |
| Zeolite water | 100 | 4.6 | 4.6 | 4.6 |
| Coconut fatty acids | 100 | 10.0 | 10.0 | 10.0 |
| Alcohol ether sulfate | 60 | 26.0 | 26.0 | 26.0 |
| Bittering agent | 25 | 0.05 | 0.05 | 0.05 |
| Tetrasodium iminodisuccinate | 33 | 0 | 0 | 0.9 |
| Optical brightener | 100 | 0.2 | 0.2 | 0.2 |
| Polymer, polyethoxylated polyethyleneimine | 80 | 6.0 | 6.0 | 6.0 |
| Sodium sulfite | 15 | 1.3 | 1.3 | 1.3 |
| Protease | 10 | 0.6 | 0.6 | 0.6 |
| Mannanase | 10 | 0 | 0.3 | 0.3 |
| amylase | 10 | 0 | 0.3 | 0.3 |
| Zinc ricinoleate | 50 | 0 | 0.02 | 0.02 |

1. All compositions are listed as weight percent, based on a total weight of the wash composition.
2. All samples were packages in polyvinyl alcohol film containers.

The unit dose pack samples from Table 1 were stored at different storage temperatures and storage periods. The color of the different samples was measured after the storage periods using a visual comparison of the wash composition with Pantone color swatches with Pantone color values of 1205, 1215, 1225, 1235, 1245, 1255, and 1265. The efflorescence was measured by visually observing the unit dose pack while overlying a black background and estimating the percentage of the surface area of the film that appears white. The testing results are listed in Table 2, below.

TABLE 2

| Sample | Storage period (weeks) | Storage temperature (° C.) | Efflorescence (% of film surface area) | Pantone color value |
|---|---|---|---|---|
| 1 | 2 | 41 | Between 1 and 25% | 1235 |
| 2 | 2 | 41 | Between 1 and 25% | 1235 |
| 3 | 2 | 41 | None | 1225 |
| 1 | 4 | 41 | About 50% | 1245 |
| 2 | 4 | 41 | About 50% | 1245 |
| 3 | 4 | 41 | None | 1225 |
| 1 | 6 | 41 | 75% or greater | 1265 |
| 2 | 6 | 41 | 75% or greater | 1265 |
| 3 | 6 | 41 | None | 1235 |
| 1 | 8 | 41 | 75% or greater | 1265 |
| 2 | 8 | 41 | 75% or greater | 1265 |
| 3 | 8 | 41 | None | 1245 |
| 1 | 2 | 45 | Between 1 and 25% | 1235 |
| 2 | 2 | 45 | Between 1 and 25% | 1235 |
| 3 | 2 | 45 | None | 1225 |
| 1 | 4 | 45 | About 50% | 1245 |
| 2 | 4 | 45 | About 50% | 1245 |
| 3 | 4 | 45 | None | 1235 |
| 1 | 6 | 45 | About 75% | 1265 |
| 2 | 6 | 45 | About 75% | 1265 |
| 3 | 6 | 45 | None | 1245 |
| 1 | 8 | 45 | 75% or greater | 1265 |
| 2 | 8 | 45 | 75% or greater | 1265 |
| 3 | 8 | 45 | None | 1245 |

NOTE:
Samples 1 and 2 are comparative samples, and Sample 3 includes both sodium sulfite and a chelating compound.

As can be seen, the combination of sodium sulfite and the chelating compound produces a wash composition that forms less color without efflorescent solids, even when stored for extended storage periods at elevated storage temperatures. The samples without the combination of both sodium sulfite and the chelating compound produced more color, and also produced efflorescent solids in the film.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A unit dose pack comprising:

a film;

a wash composition encapsulated within the film to form the unit dose pack, wherein the wash composition comprises an ionic surfactant, water, sodium sulfite at from about 0.05 to about 3 weight percent based on a total weight of the wash composition, and a chelating compound at from about 0.01 to about 1.5 weight percent based on the total weight of the wash composition, wherein the wash composition is free of dyes, pigments, fragrances, and perfumes.

2. The unit dose pack of claim 1 wherein the wash composition comprises the ionic surfactant at from about 1 weight percent to about 10 weight percent, based on the total weight of the wash composition.

3. The unit dose pack of claim 2 wherein the wash composition further comprises a pH adjusting agent, and wherein the pH adjusting agent comprises monoethanol amine.

4. The unit dose pack of claim 2 wherein the wash composition comprises a coconut fatty acid at from about 2 weight percent to about 20 weight percent, based on the total weight of the wash composition.

5. The unit dose pack of claim 1 wherein the chelating compound comprises iminodisuccinate.

6. The unit dose pack of claim 1 wherein the chelating compound comprises tetrasodium iminodisuccinate.

7. The unit dose pack of claim 1 wherein a chelator to sulfite ratio of the weight percent of the chelating compound to the weight percent of the sodium sulfite is from about 5:1 to about 1:5.

8. The unit dose pack of claim 1 wherein a chelator to sulfite ratio of the weight percent of the chelating compound to the weight percent of the sodium sulfite is from about 3:1 to about 1:1.

9. The unit dose pack of claim 1 wherein a chelator to sulfite ratio of the weight percent of the chelating compound to the weight percent of the sodium sulfite is from about 2:1 to about 1:1.

10. The unit dose pack of claim 9 wherein the wash composition comprises the sodium sulfite at from about 0.05 to about 2 weight percent and the wash composition comprises the chelating compound at from about 0.05 to about 1 weight percent, wherein the weigh percents are based on the total weight of the wash composition.

11. The unit dose pack of claim 1 wherein the chelating compound is present in the wash composition at from about 0.05 to about 0.5 weight percent based on the total weight of the wash composition, and wherein the chelating compound comprises two or more sodium atoms per molecule of the chelating compound.

12. The unit dose pack of claim 1 wherein the sodium sulfite is present in the wash composition at from about 0.05 to about 2 weight percent, based on the total weight of the wash composition.

13. The unit dose pack of claim 1 wherein:

the sodium sulfite is present in the wash composition at from about 0.05 to about 2 weight percent, based on the total weight of the wash composition; and the chelating compound comprises tetrasodium iminodisuccinate at from about 0.05 to about 1 weight percent, based on the total weight of the wash composition.

14. The unit dose pack of claim 1 further comprising:

water at from about 10 to about 25 weight percent, based on the total weight of the wash composition;

a coconut fatty acid at from 0.05 to about 10 weight percent, based on the total weight of the wash composition;

an optical brightener at from about 0.01 to about 0.5 weight percent, based on the total weight of the wash composition; and an enzyme at from about 0.001 to about 5 weight percent, based on the total weight of the wash composition.

15. A unit dose pack comprising:

a film, wherein the film is water soluble;

a wash composition encapsulated within the film, wherein the wash composition comprises;

sodium sulfite at from about 0.05 to about 2 weight percent, based on a total weight of the wash composition;

a chelating compound at from about 0.05 to about 1.0 weight percent, based on the total weight of the wash composition, wherein the chelating compound comprises tetrasodium iminodisuccinate, and wherein a chelator to sulfite ratio of the weight percent of the chelating compound to the weight percent of the sodium sulfite is from about 2:1 to about 1:1;

an ionic surfactant at from about 2 to about 12 weight percent, based on the total weight of the wash composition;

water at from about 10 to about 25 weight percent, based on the total weight of the wash composition;

wherein the wash composition is free of dyes, pigments, fragrances, and perfumes.

16. A method of preventing efflorescence and yellowing of a wash composition comprising:

forming the wash composition comprising:

an ionic surfactant;

water;

sodium sulfite at from about 0.05 to about 3 weight percent, based on a total weight of the wash composition; and a chelating compound at from about 0.05 to about 0.5 weight percent, based on the total weight of the wash composition, wherein the wash composition is free of dyes, pigments, fragrances, and perfumes; and encapsulating the wash composition in a container to form a unit dose pack, wherein the container comprises a film.

17. The method of claim 16 wherein forming the wash composition comprises adding the sodium sulfite and the chelating compound at a chelator to sulfite ratio of the weight percent of the chelating compound to the weight percent of the sodium sulfite of from about 5:1 to about 1:5.

18. The method of claim 16 wherein forming the wash composition comprises adding the sodium sulfite and the chelating compound at a chelator to sulfite ratio of the weight percent of the chelating compound to the weight percent of the sodium sulfite of from about 3:1 to about 1:1.

19. The method of claim 16:

wherein upon storing the unit dose pack for a storage period of about two weeks or more at a storage temperature of about 37° C. (100° F.) or more, a surface area of the film comprises about 5% or less of efflorescent solids after the storage period, and wherein the wash composition has a Pantone color of from 1205 to 1245 after the storage period.

* * * * *